US007455288B2

(12) United States Patent
Ruhe et al.

(10) Patent No.: US 7,455,288 B2
(45) Date of Patent: Nov. 25, 2008

(54) SHEET MEDIA INPUT STRUCTURE

(75) Inventors: Tom Ruhe, La Center, WA (US); Jiangxiao Mo, Vancouver, WA (US); Kelly A. Brock, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 788 days.

(21) Appl. No.: 10/463,486

(22) Filed: Jun. 16, 2003

(65) Prior Publication Data

US 2004/0251602 A1 Dec. 16, 2004

(51) Int. Cl.
*B65H 3/52* (2006.01)

(52) U.S. Cl. ..... 271/124

(58) Field of Classification Search ..... 271/121, 271/126, 124, 267, 137, 104
See application file for complete search history.

(56) References Cited

U.S. PATENT DOCUMENTS 4,541,623 A * 9/1985 Huerta ..... 271/37
4,997,176 A * 3/1991 Hain ..... 271/180
5,253,854 A * 10/1993 Tanoue et al. ..... 271/10.12
5,386,983 A * 2/1995 Ando ..... 271/118
5,857,671 A * 1/1999 Kato et al. ..... 271/10.11
5,927,706 A * 7/1999 Hiroi et al. ..... 271/117
5,934,664 A * 8/1999 Murayama et al. ..... 271/118
5,971,390 A * 10/1999 Caspar et al. ..... 271/121
6,065,886 A * 5/2000 Embry et al. ..... 400/629
6,126,161 A * 10/2000 Kato ..... 271/121
6,158,733 A * 12/2000 Muraki ..... 271/127
6,170,701 B1 * 1/2001 Youn ..... 221/126
6,217,017 B1 * 4/2001 Yamazaki ..... 271/121
6,331,002 B1 * 12/2001 Yoshino et al. ..... 271/117
6,338,480 B1 * 1/2002 Endo ..... 271/104
6,375,183 B1 * 4/2002 Inoue et al. ..... 271/10.11
6,382,621 B1 * 5/2002 Inoue et al. ..... 271/120
6,540,220 B2 * 4/2003 Kuo et al. ..... 271/118
6,540,221 B2 * 4/2003 Nakashima et al. ..... 271/121
6,880,821 B2 * 4/2005 Park ..... 271/121
2004/0251592 A1 * 12/2004 Ruhe et al. ..... 271/109

FOREIGN PATENT DOCUMENTS

JP 62096229 A * 5/1987
JP 5-201556 * 8/1993

* cited by examiner

*Primary Examiner*—Patrick H Mackey
*Assistant Examiner*—Michael C McCullough

(57) ABSTRACT

In one embodiment, a sheet media input structure comprises a sheet media supporting surface and a movable feature downstream from the supporting surface along a media path that extends from the supporting surface to and along the movable feature. The feature is configured to separate a top sheet on a stack of sheets supported on the supporting surface from a next-to-top sheet in the stack. The feature movable between a first position in which the feature impedes a leading edge of sheets fed from the stack along the media path to separate a top sheet from a next-to-top sheet and a second position in which the feature does not impede the leading edge of sheets fed along the media path.

7 Claims, 11 Drawing Sheets

SHEET MEDIA INPUT STRUCTURE

FIELD OF THE INVENTION

The invention relates to an input structure for printers and other sheet media processing devices.

BACKGROUND

In many printers, individual sheets of paper or other print media are fed into the printer off the top of a stack of sheets held in a tray. Typically, a pick roller is rotated against the top sheet to slide the top sheet off the stack and into a set of feed rollers that feed the sheet into the print engine. The friction between sheets in the stack sometimes causes the top two or three sheets in the stack to stick together as the top sheet is picked from the stack. The next-to-top sheets must be separated from the top sheet to avoid feeding multiple sheets into the print engine at the same time.

In one conventional input structure, the next-to-top sheets are separated from the top sheet by driving the sheets against an angled wall positioned at the front of the media input tray. This separation wall also functions as a load stop to prevent the user from pushing media too far into the printer when a media stack is loaded into the tray. Since the wall is angled, however, it is comparatively easy for the user to push the stack partially up the separation wall and too far into the printer, which prevents effective sheet separation.

In some printers, an elastomeric pad is embedded in the separation wall to make it more difficult for a user to load the media stack too far into the printer. The compressibility and high surface friction of the pad create a desirable increase in the resistance to the media stack during loading. Unfortunately, a pad that creates enough resistance to function as an effective load stop can also create too much resistance to the top sheet picked from the stack and pushed up the separation wall along the pad. The present invention was developed in an effort to balance the need for a higher resistance load stop with the need for a lower resistance sheet picking feature.

DRAWINGS

Figure 6:
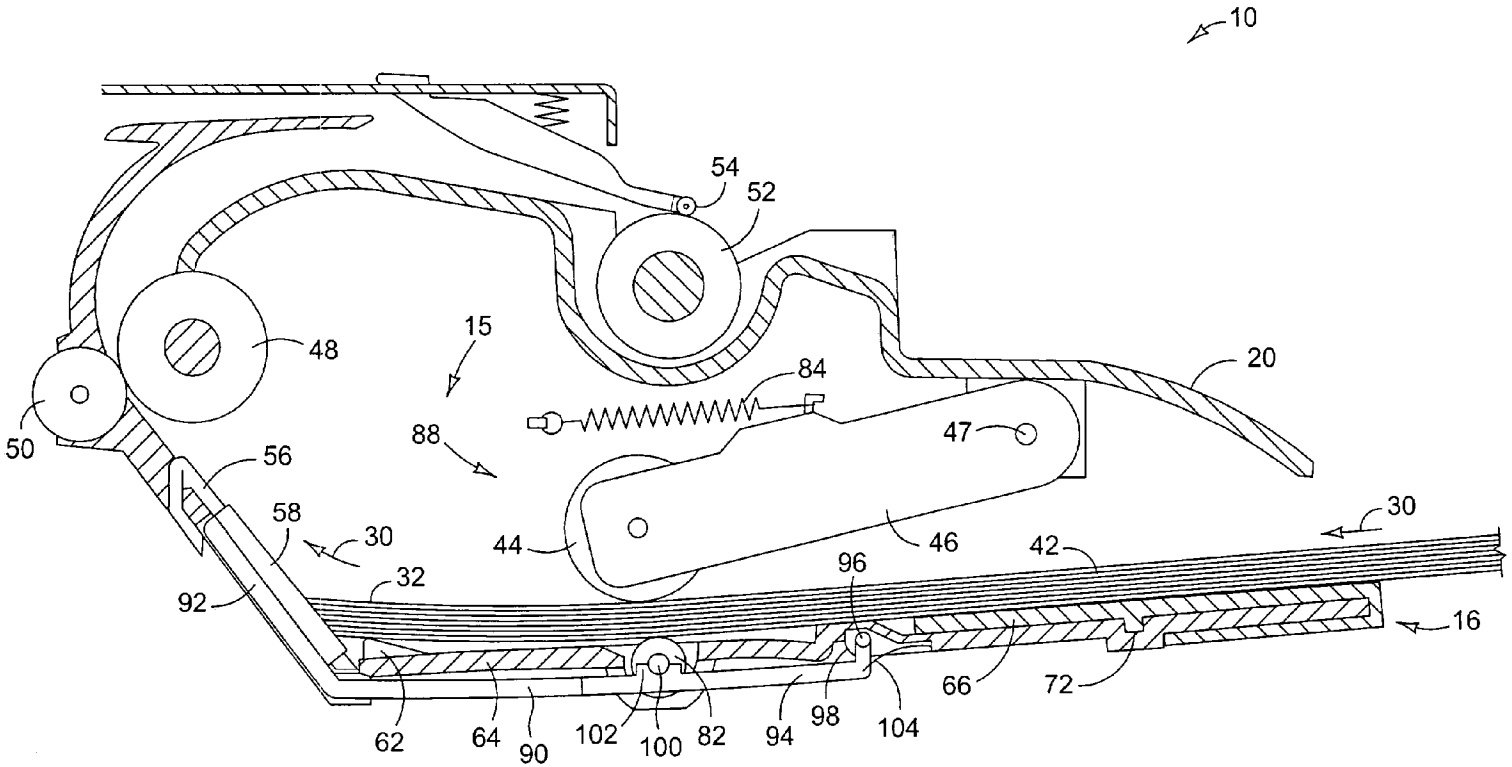
Figure 7:
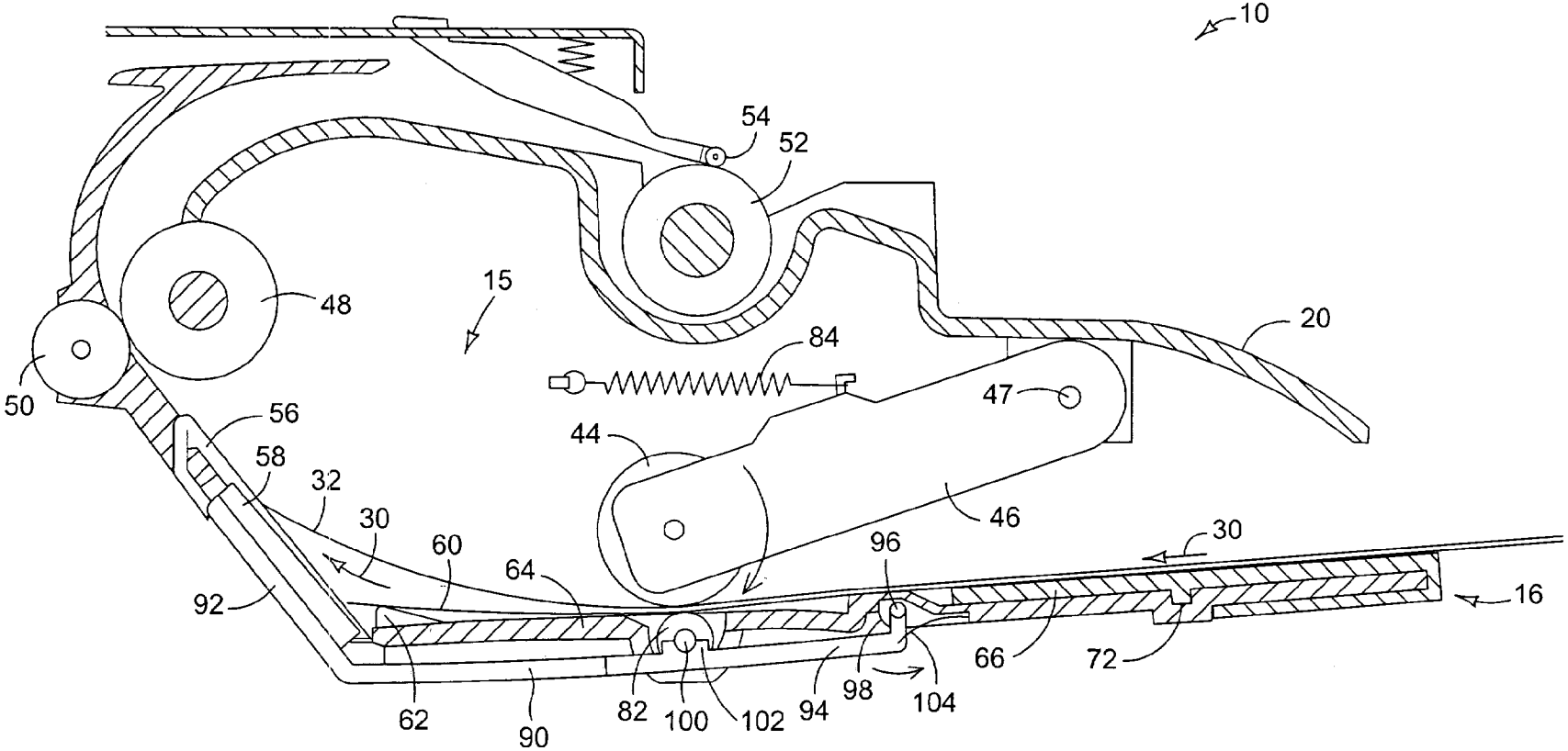

FIGS. 6 and 7 are side elevation and partial section views of a media input structure constructed according to one embodiment of the invention. In FIG. 6, the separator pad is exposed to the media path. In FIG. 7, the separator pad is shielded from the media path.

Figure 8:
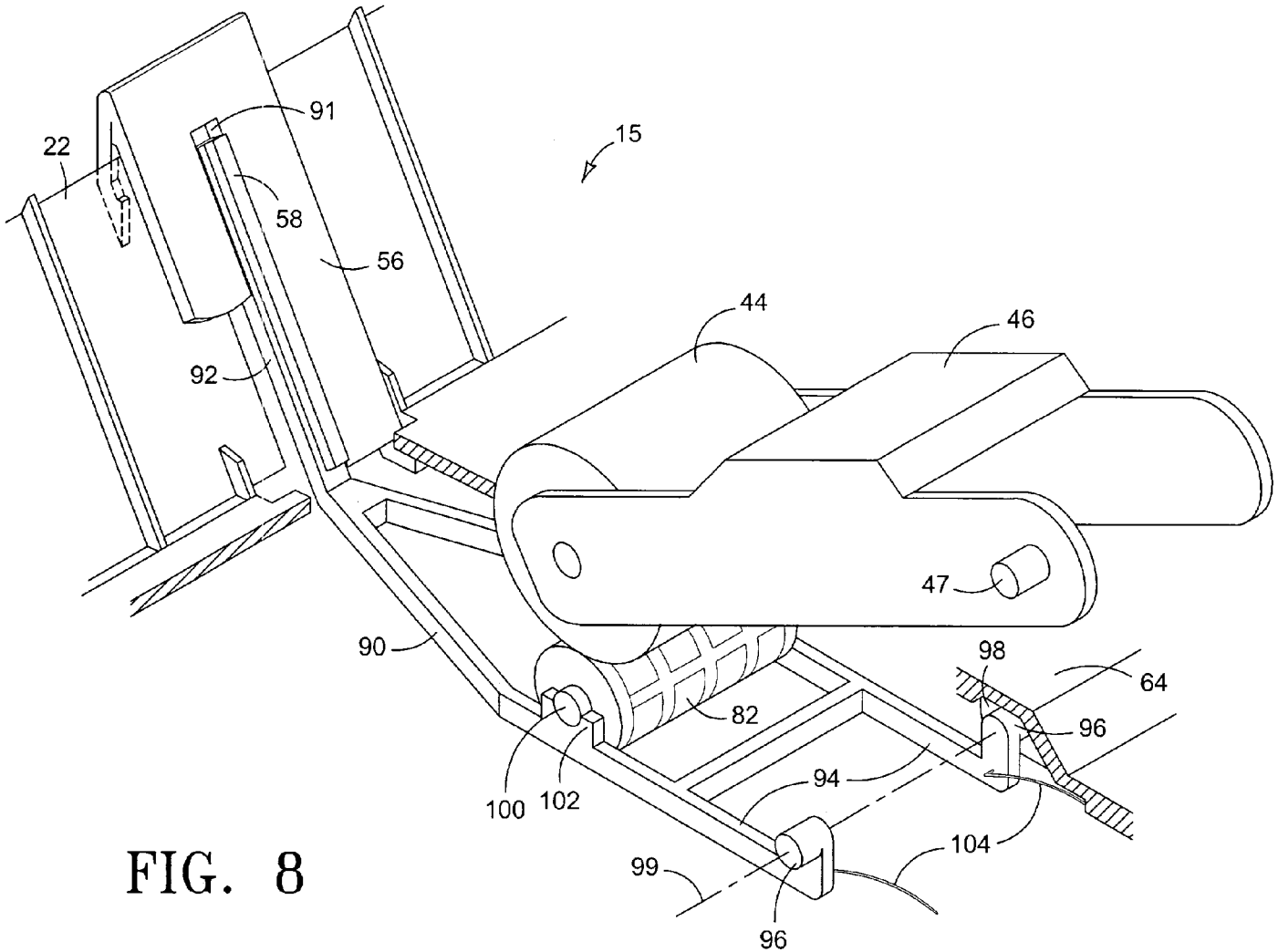

FIG. 8 is a perspective detail view of the media input structure shown in FIGS. 6 and 7.

Figure 9:
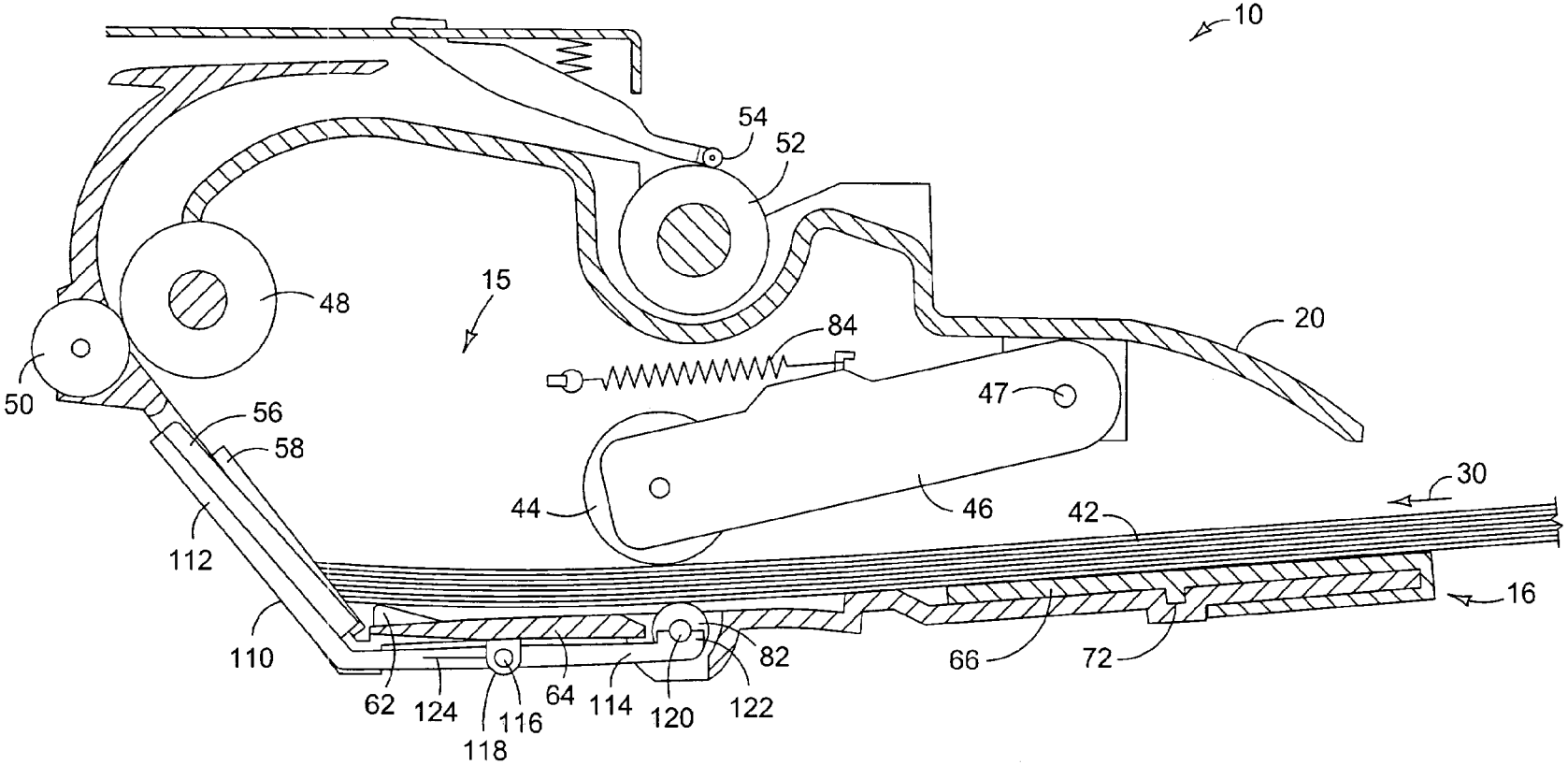
Figure 10:
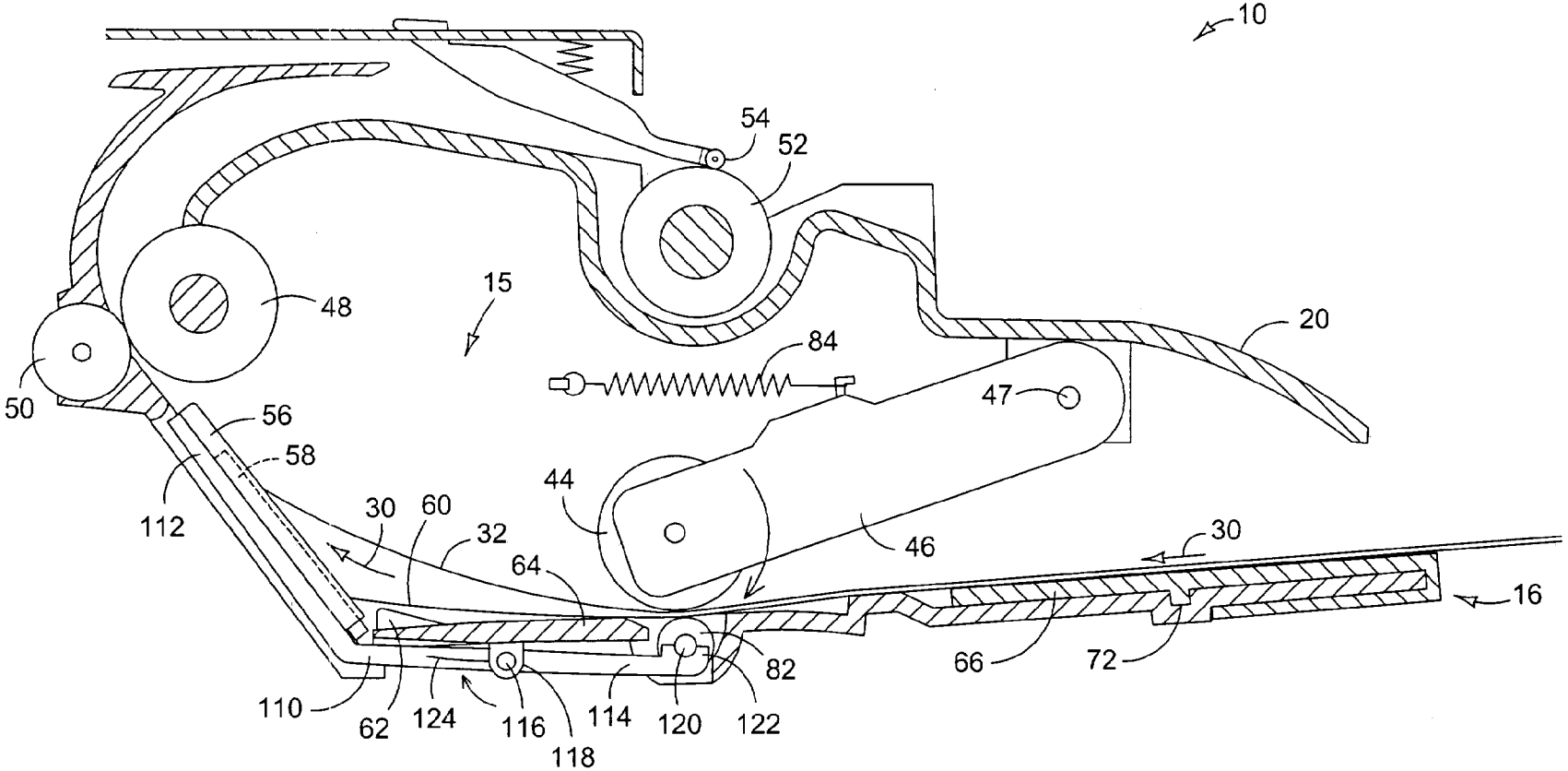

FIGS. 9 and 10 are side elevation and partial section views of a media input structure constructed according to a second embodiment of the invention. In FIG. 9, the separator pad is exposed. In FIG. 10, the separator pad is hidden.

Figure 11:
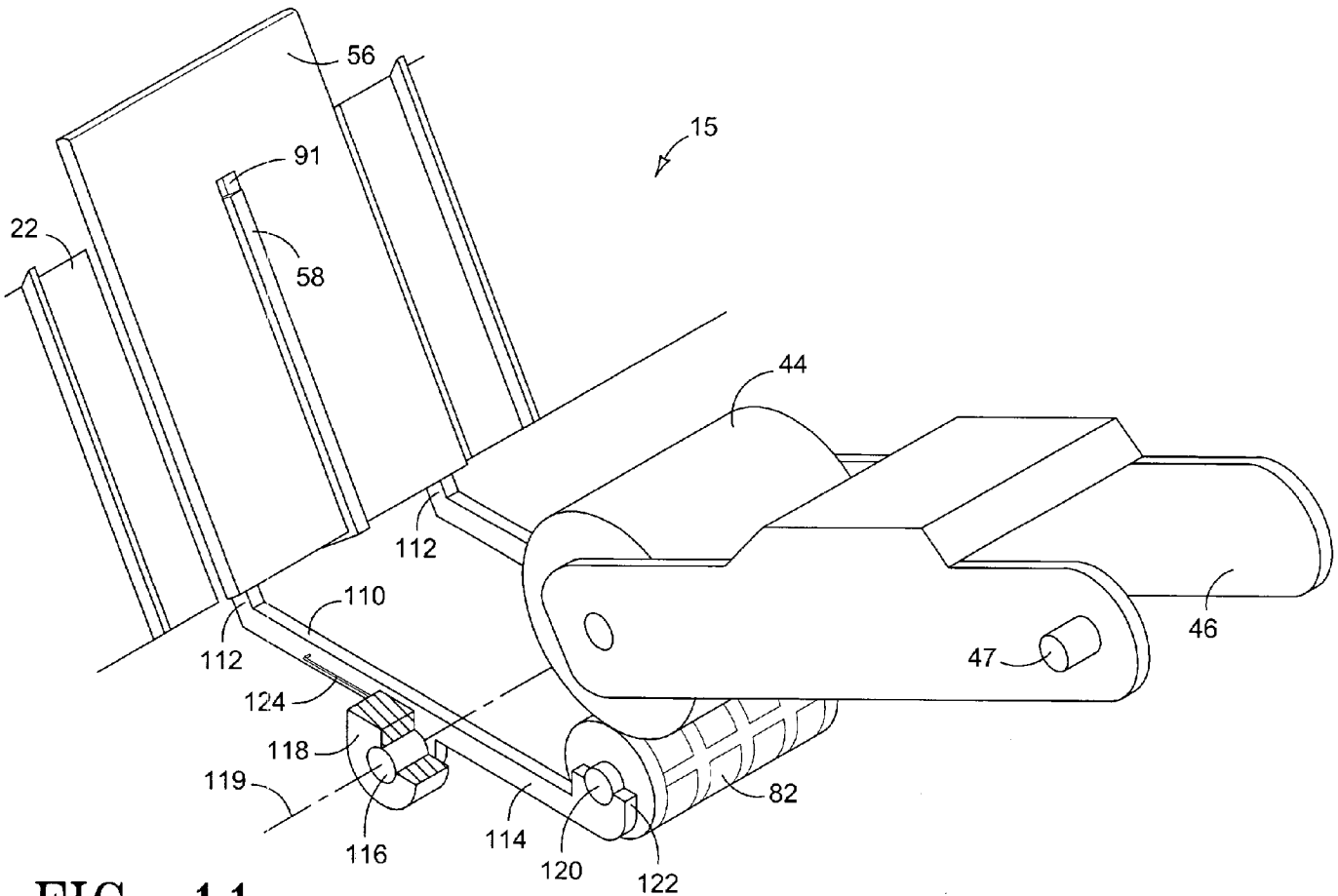

FIG. 11 is a perspective detail view of the media input structure shown in FIGS. 9 and 10.

DESCRIPTION

Embodiments of the invention will be described with reference to the ink-jet printer shown in FIGS. 1 and 2. The invention, however, is not limited to use with inkjet printers. Embodiments of the invention may be implemented in any printer or other sheet media processing device in which it is necessary or desirable to balance the need for a higher resistance load stop with the need for a lower resistance sheet picking feature. While the invention is not limited to use with inkjet printers, it is expected that various embodiments of the invention will be particularly useful in printers with a U-shaped media path typical of many inkjet printers in which the print media is fed at a steep angle from a horizontal tray.

Figure 1:
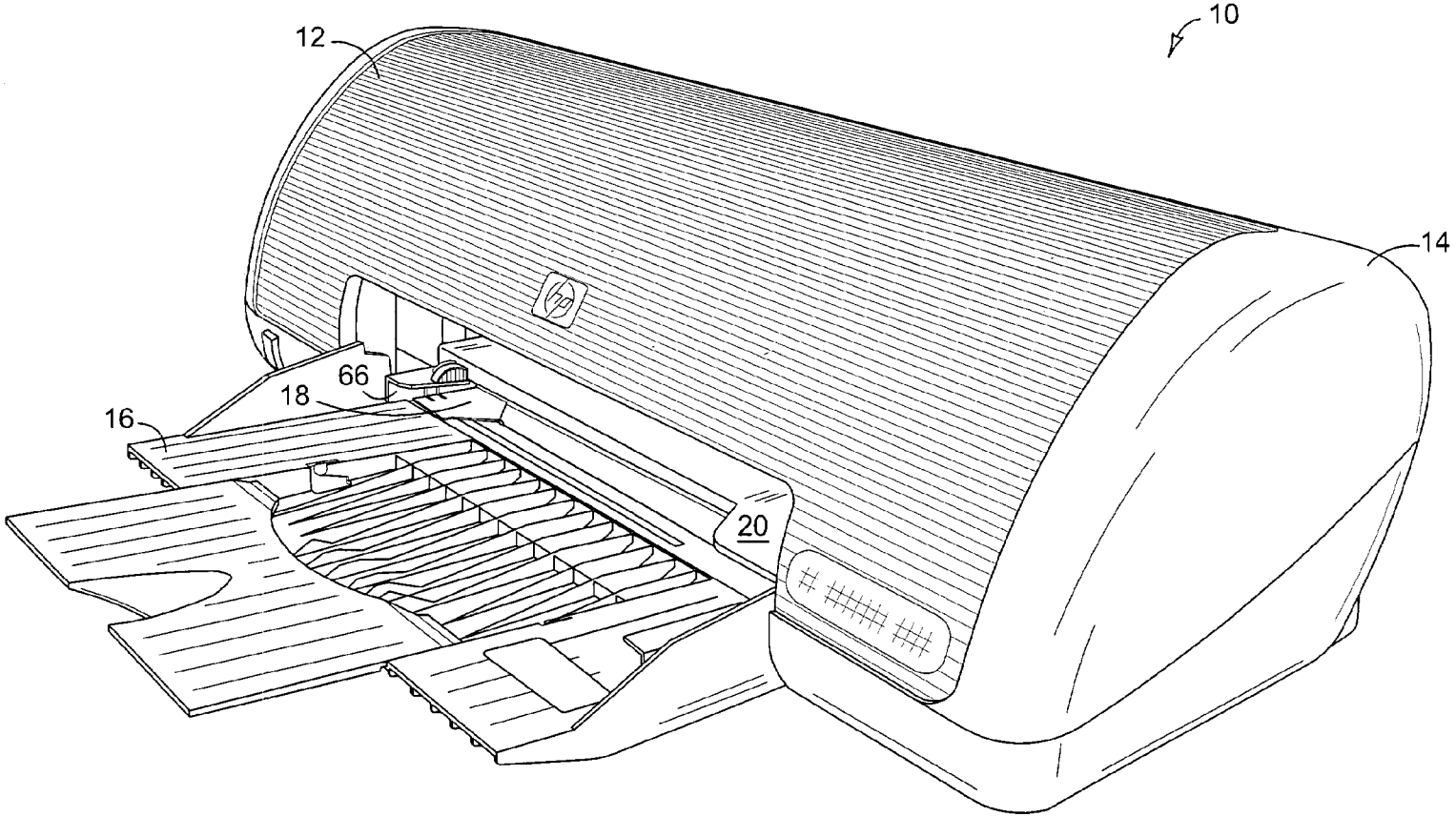
FIG. 1 is a perspective view of an inkjet printer.
Figure 4:
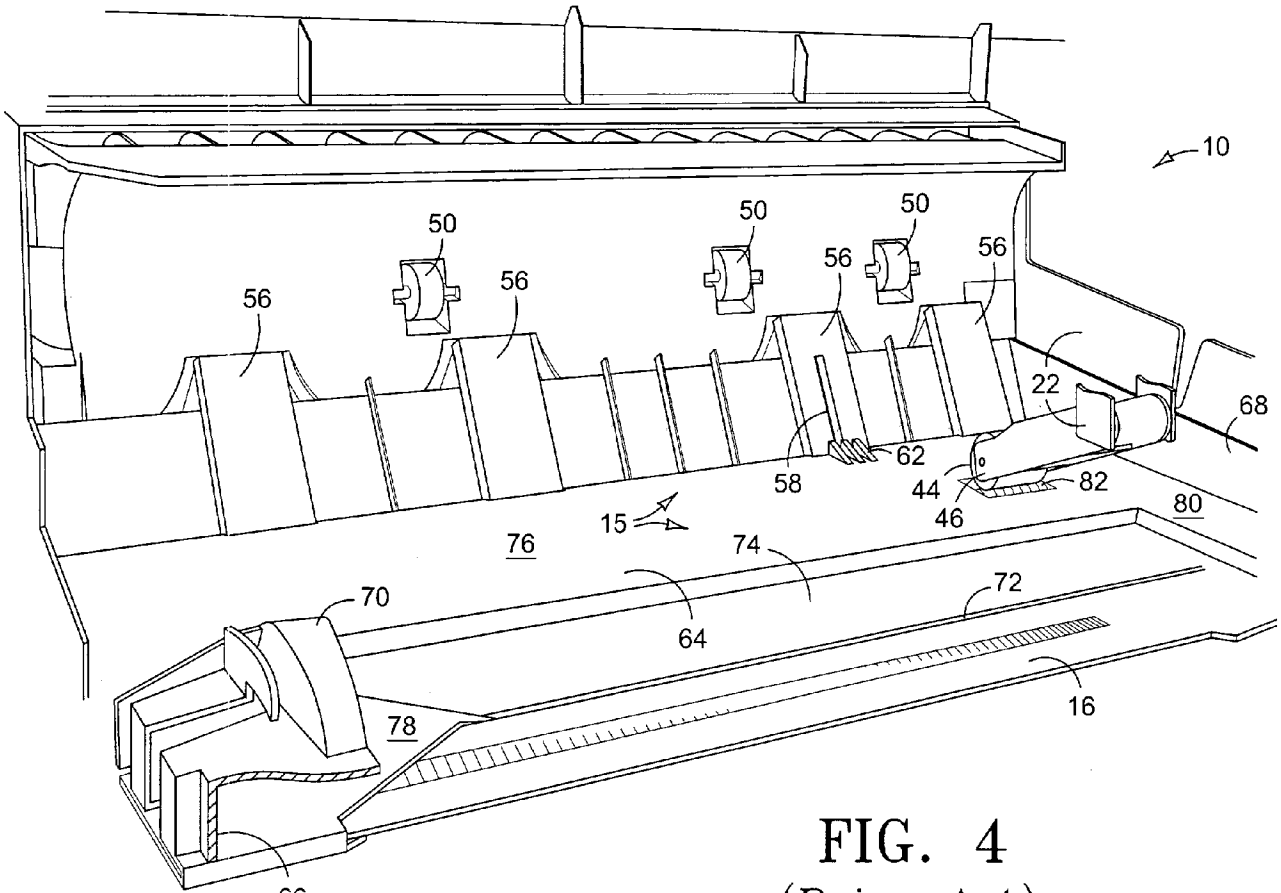
FIG. 4 (Prior Art)
FIG. 4 is a perspective view showing in more detail the media input structure of the printer of FIG. 3.
Figure 5:
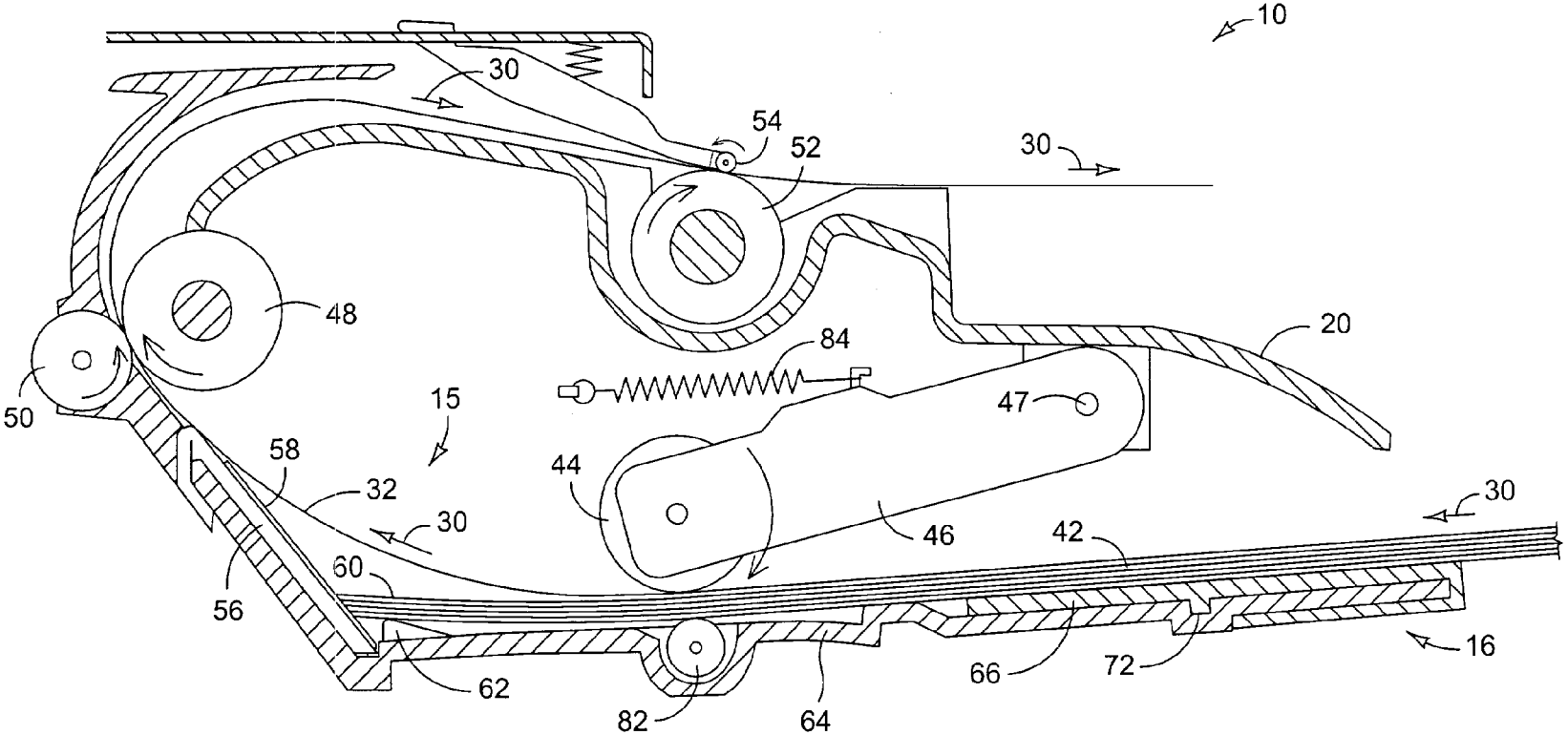
FIG. 5 (Prior Art)
FIG. 5 is a side elevation and partial section view of the media input structure shown in FIG. 4.

FIG. 1 illustrates an inkjet printer 10. FIG. 2 shows inkjet printer 10 with cover 12 (FIG. 1) and other parts of housing 14 removed. FIG. 3 is a side elevation and partial section view of an inkjet printer 10 such as the one shown in FIGS. 1 and 2 with a conventional input structure, designated generally by reference number 15. FIG. 4 is a perspective view of a conventional input structure 15 and components of the media sheet pick mechanism used in printer 10. A conventional input structure is discussed first, along with the other components of printer 10, to better distinguish the various embodiments of the input structure of the present invention. FIGS. 3-5 show a conventional input structure. FIGS. 6-8 and 9-11 show two embodiments of a new input structure.

Figure 2:
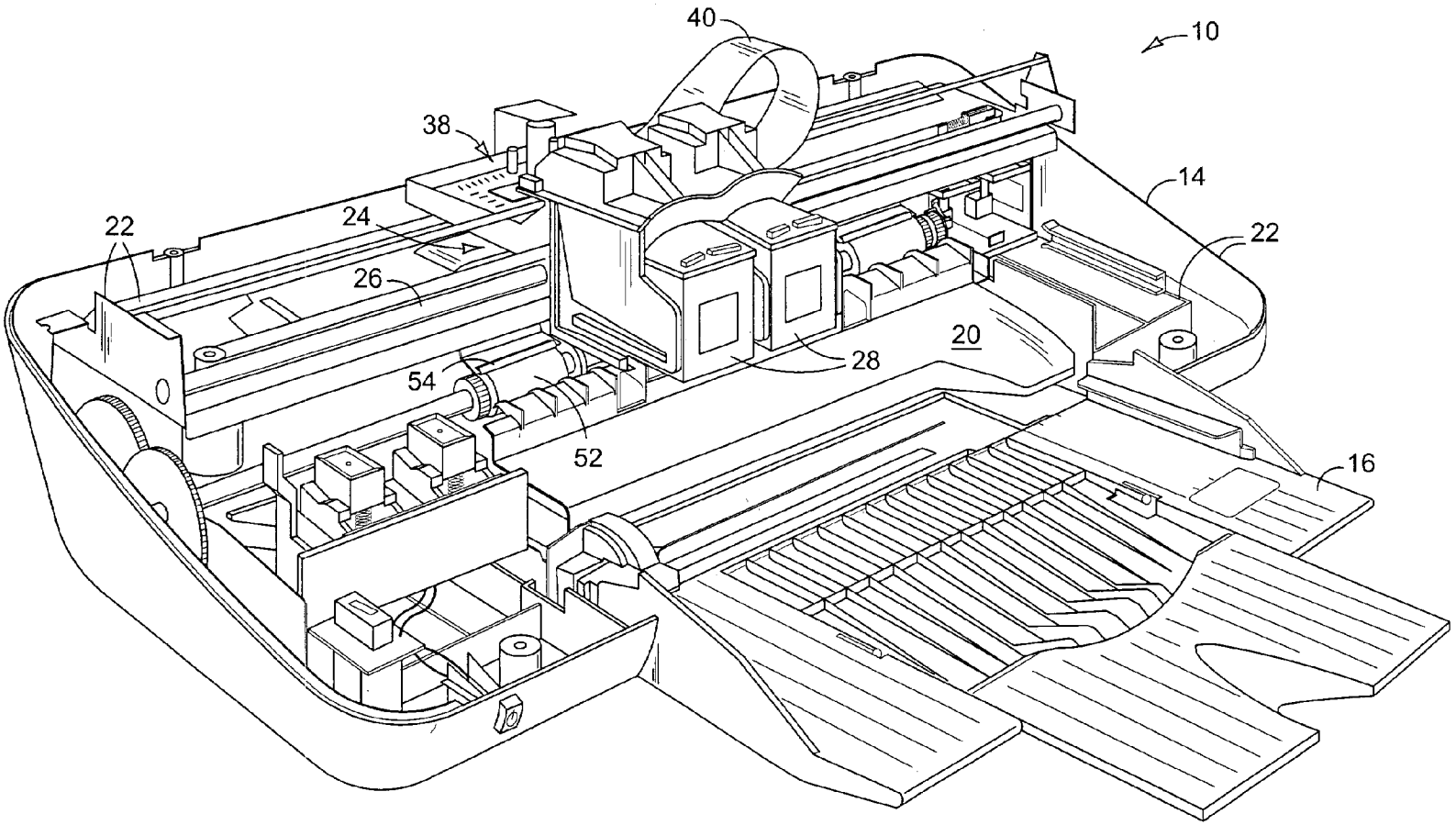
FIG. 2 is a perspective view of an inkjet printer such as the one shown in FIG. 1 with the cover and other parts of the housing removed.
Figure 3:
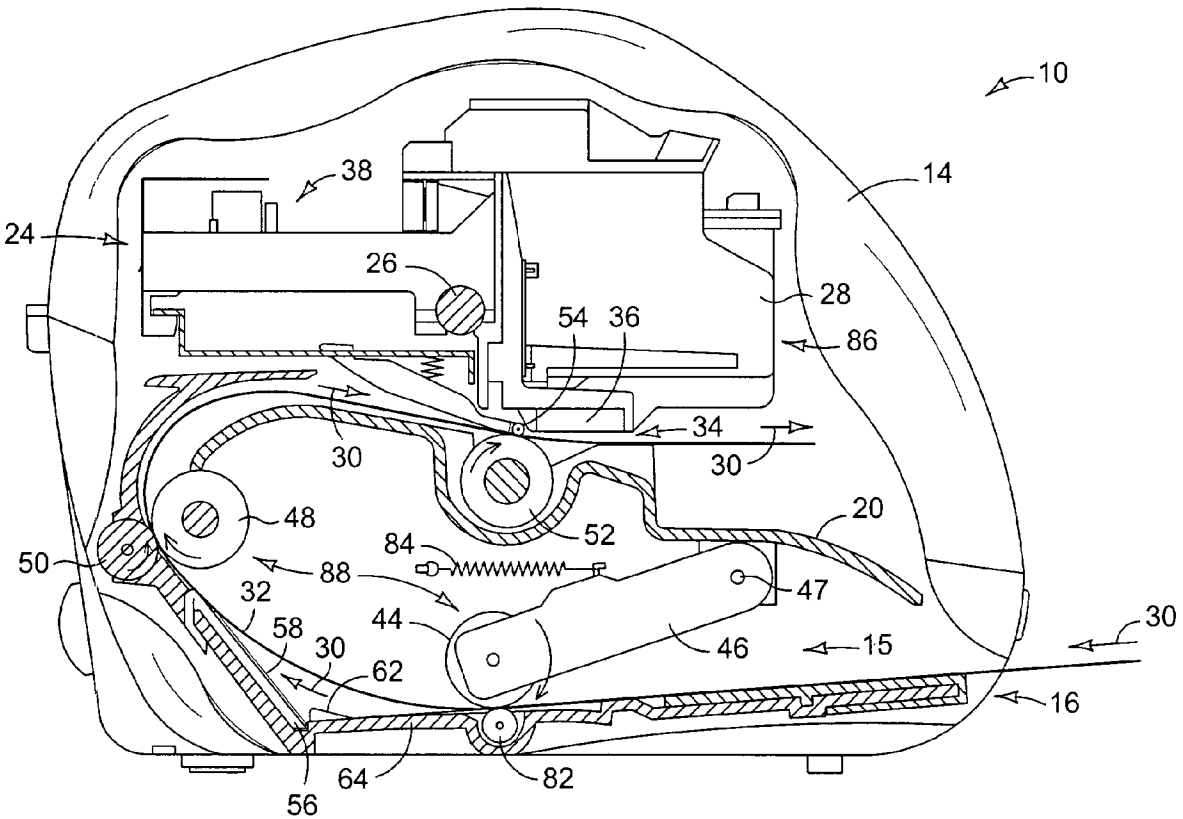
FIG. 3 (Prior Art)
FIG. 3 is a side elevation and partial section view of an inkjet printer such as the one shown in FIG. 2 with a conventional media input structure.

Referring first to FIGS. 1-3, printer 10 includes a cover 12 and a housing 14. A sheet media tray 16 is positioned at the bottom of printer 10 along an opening 18 in housing 14. Paper or other print media sheets 32 (FIG. 3) are stacked in tray 16 for input to printer 10 and printed sheets are output back through opening 18 over tray 16. A supporting surface 20 helps suspend the trailing edge of the printed sheets over tray 16.

Printer 10 includes a chassis 22 that supports the operative components of printer 10. Chassis 22 represents generally those parts of housing 14 along with other structurally stable elements in printer 10 that support the operative components of printer 10. A printhead carriage 24 is driven back and forth along a guide rail 26 mounted to chassis 22. Any suitable drive mechanism may be used to move carriage 24. A reversing motor (not shown) coupled to carriage 24 through a belt and pulley system (not shown), for example, is one carriage drive mechanism commonly used in inkjet printers.

Carriage 24 has stalls for holding one or more printheads 28. In the printer shown in FIGS. 1-3, carriage 24 carries two printheads 28—one printhead containing color ink for color printing and one printhead containing black ink for monochrome printing. Printheads 28 are also commonly referred to as print cartridges or ink cartridges. As best seen in FIG. 3, printheads 28 are positioned along media path 30 such that each sheet of print media 32 passes directly under printheads 28 at print zone 34. The bottom 36 of each printhead 28, which faces media sheet 32, includes an array of nozzles through which drops of ink are ejected onto media sheet 32.

An electronic printer controller 38 receives print data from a computer, scanner, digital camera or other image generating device. Controller 38 controls the movement of carriage 24 back and forth across media sheet 32 and the advance of media sheet 32 along media path 30. Printer controller 38 is also electrically connected to printheads 28 through, for example, a flexible ribbon cable 40. As carriage 24 carries printheads 28 across media sheet 32, printer controller 38 selectively activates ink ejection elements in printheads 28 according to the print data to eject ink drops through the nozzles onto media sheet 32. By combining the movement of carriage 24 across media sheet 32 with the movement of sheet 32 along media path 30, controller 38 causes printheads 28 to eject ink onto media sheet 32 to form the desired print image.

FIG. 4 is a perspective view of a conventional input structure 15 and components of the media sheet pick mechanism. FIG. 5 is a side elevation and partial section view showing conventional input structure 15 and pick/feed mechanism components along media path 30. FIG. 5 shows a stack 42 of media sheets in tray 16 and a top sheet 32 being fed along media path 30. Referring to FIGS. 4 and 5, top sheet 32 is "picked" from a stack 42 of media sheets in tray 16 and fed along media path 30. A pick roller 44, mounted on a pick roller swing arm 46, rests on top sheet 32. When a sheet is needed for printing, pick roller 44 is driven clockwise at the direction of controller 38 to grab top sheet 32 and feed it along media path 30 toward transport roller 48. Transport roller 48 bears against idler roller 50 to form a nip that moves sheet 32 along toward output roller 52. Output roller 52 bears against idler arm 54 to form a nip that moves sheet 32 onto sheet output supporting surface 20.

Each sheet 32 is guided from tray 16 toward transport roller 48 along guide ramps 56. Guide ramps 56 also function as angled separation walls that help prevent any next-to-top sheets carried along with top sheet 32 from moving into the transport roller nip. One or more separator pads 58 are commonly used to improve sheet separation or to more effectively block a stack 42 from being loaded too far into printer 10. Separator pad 58 represents generally any comparatively soft structural feature that protrudes from the face of wall 56 or otherwise extends into media path 30 between tray 16 and transport roller 48 that is configured to help separate next-to-top sheets carried along with top sheet 32 from moving into the transport roller nip. Separator pad 58 is typically constructed as an elastomeric strip that protrudes from the face of wall 56. The force of pick roller 44 on top sheet 32 is sufficient to overcome the resistance of separator pad 58 while the next-to-top sheet 60, which is dragged along with only a much smaller sheet-to-sheet friction force, will be stopped by pad 58. That is to say, pad 58 separates next-to-top sheet 60 from top sheet 32. A stack ramp 62 is also sometimes provided to elevate the leading edge of sheets in the stack 42 to reduce the force needed to feed top sheet 32 past separator pad 58.

Media tray 16 includes a base panel 64 extending between sidewalls 66 and 68. Media tray 16 typically includes a mechanism to adjust the width of the tray to accommodate different width media. In the printer 10 illustrated in the figures, left sidewall 66 is integral to a slider 70 that slides along a slot 72 in a recess 74 in base panel 64 to adjust for differing width media. Base panel 64 and slider 70 define media support surfaces 76, 78 and 80.

Pick roller swing arm 46 is mounted to chassis 22 at a swing arm pivot 47 located upstream and above pick roller 44 such that pick roller 44 swings down counter-clockwise against stack 42. An idler roller 82 is recessed into base panel 64 directly below pick roller 44. When tray 16 is empty, pick roller 44 rests on idler roller 82. In the event pick roller 44 is activated when tray 16 is empty, pick roller 44 will turn on idler roller 82 and, therefore, avoid any damage to pick roller 44 or other pick mechanism components. A biasing spring 84 urges pick roller swing arm 46 down to maintain contact between pick roller 44 and top sheet 32 in stack 42.

Carriage 24 and printheads 28 along with other hardware components necessary to deliver ink to the print media are referred to collectively as print engine 86 (FIG. 3). Rollers 44/82, 48/50 and 52/54 along with other hardware components necessary to transport the print media through printer 10 are referred to collectively as pick/feed mechanism 88 (FIG. 3). Controller 38 includes the programming, processor and associated memory and electronic circuitry necessary to control print engine 86, pick/feed mechanism 88, and the other operative components of printer 10.

The components of printer 10 described above are all conventional components well known to those skilled in the art of inkjet printing. Therefore, additional structural and operational details of these components are omitted except as noted below for input structure 15.

One embodiment of the invention will now be described with reference to FIGS. 6-8. FIGS. 6 and 7 are side elevation and partial section views of a media input structure 15 constructed according to a first embodiment of the invention. FIG. 8 is an enlarged perspective view of input structure 15 and components of the media sheet pick mechanism 88. Referring to FIGS. 6-8, input structure 15 includes a pad swing arm 90 that carries separator pad 58 between a blocking position shown in FIG. 6, in which pad 58 protrudes into media path 30, and a retracted position shown in FIG. 7, in which pad 58 is shielded from media path 30 by angled separator wall 56. In the embodiment shown in the figures, separator pad 58 is positioned in a recess 91 along the middle of wall 56. Pad swing arm 90 extends from a forward upright part 92 that carries separator pad 58 to rearward generally horizontal parts 94 mounted to tray base panel 64 at pivot pins 96. Each pivot pin 96 is mounted in a hub 98 in base panel 64 along an axis of rotation 99 (FIG. 8). Pick idler roller 82 is mounted across swing arm rearward parts 94 on axles 100 that rotate in hubs 102. Pick idler roller 82 is positioned between axis of rotation 99 and swing arm upright 92 so that swing arm upright 92 swings down in response to downward pressure exerted on pick idler roller 82. Springs 104 operatively coupled between base panel 64 and pad swing arm 90, or another suitable biasing mechanism, constantly urge pad swing arm 90 to an upward rotation to bias separator pad 58 toward the blocking position.

When a stack of media sheets is loaded into tray 16, there is little if any normal force pressing down on idler roller 82 and biasing springs 104 hold pad swing arm 90 up with separator pad 58 in the blocking position shown in FIG. 6. In this position, separator pad 58 helps block stack 42 from being loaded too far in printer 10. When a top sheet 32 is picked from a full stack 42, as shown in FIG. 6, the normal force generated by pick roller 44 pressing against top sheet 32 is small and readily dissipated through stack 42. As stack 42 gets smaller and pick roller swing arm 46 swings further down, as shown in FIG. 7, more of the pick force is applied as a pivoting force to drive pick roller swing arm 46 down and press pick roller 44 harder against stack 42. Also, there are fewer sheets in stack 42 to dissipate the increasing normal force. Hence, more of the normal force reaches idler roller 82 and pad swing arm 90. When the normal force is sufficient to overcome the resistance of springs 104, pad swing arm 90 begins to rotate down, moving separator pad 58 out of media path 30, as best seen by comparing FIGS. 6 and 7. In FIG. 6, top sheet 32 must pass along the full length of separator pad 58. In FIG. 7, by contrast, top sheet 32 is shielded from separator pad 58 by angled separator wall 56.

The mechanism tends to be self-adjusting. When more of separator pad 58 is exposed to the leading edge of top sheet 32, a larger pick force is required to pick top sheet 32 and push it past separator pad 58. An increasing pick force means an increasing normal force pressing down on stack 42. The increasing normal force, however, urges separator pad 58 away from media path 30, which decreases the pick force needed to pick top sheet 32 and push it past separator pad 58 to facilitate picking thicker and stiffer print media. The decreasing pick force means a decreasing normal force pressing down on stack 42. The decreasing normal force allows more of separator pad 58 into media path 30, which increases media separation and helps prevent multiple picks for thinner and lighter print media.

In a second embodiment shown in FIGS. 9-11, separator wall 56 moves to shield a stationary separator pad 58 to vary the blocking effect of separator pad 58. Referring to FIGS. 9-11, input structure 15 includes a wall swing arm 110 that carries an angled separator wall 56 between an open position shown in FIG. 9, in which pad 58 is exposed to media path 30, and a shielding position shown in FIG. 10, in which pad 58 is shielded from media path 30 by wall 56. In the embodiment shown in the figures, separator pad 58 is positioned in a recess 91 along the middle of wall 56. Wall swing arm 110 extends from forward upright parts 112 that carry wall 56 to rearward generally horizontal parts 114 mounted to tray base panel 64 at pivot pins 116. Each pivot pin 116 is mounted in a hub 118 in base panel 64 along an axis of rotation 119 (FIG. 11). Pick idler roller 82 is mounted across swing arm parts 114 on axles 120 that rotate in hubs 122. Axis of rotation 119 is positioned between swing arm uprights 112 and pick idler roller 82 so that swing arm uprights 112 swing up in response to downward pressure exerted on pick idler roller 82. Springs 124 operatively coupled between hubs 118 in base panel 64 and wall swing arm 110, or another suitable biasing mechanism, constantly urge wall swing arm 110 to a downward rotation to bias wall 56 toward the open position in which separator pad 58 is exposed to media path 30.

When a stack of media sheets is loaded into tray 16, there is little if any normal force pressing down on idler roller 82 and biasing springs 124 hold wall swing arm 110 down with wall 56 in the open position shown in FIG. 9. In this position, separator pad 58 is exposed to media path 30 to help block stack 42 from being loaded too far in printer 10. When a top sheet 32 is picked from a full stack 42, as shown in FIG. 9, the normal force generated by pick roller 44 pressing against top sheet 32 is small and readily dissipated through stack 42. As stack 42 gets smaller and pick roller swing arm 46 swings further down, as shown in FIG. 10, more of the pick force is applied as a pivoting force to drive pick roller swing arm 46 down and press pick roller 44 harder against stack 42. Also, there are fewer sheets in stack 42 to dissipate the increasing normal force. Hence, more of the normal force reaches idler roller 82 and wall swing arm 110. When the normal force is sufficient to overcome the resistance of springs 124, wall swing arm 110 begins to rotate, moving wall 56 into media path 30 to shield separator pad 58, as best seen by comparing FIGS. 9 and 10. In FIG. 9, top sheet 32 must pass along the full length of separator pad 58. In FIG. 10, by contrast, top sheet 32 is shielded from separator pad 58 by angled separator wall 56.

For a conventional input structure, as stack 42 gets smaller, the resistance of separator pad 58 to sheets fed off stack 42 increases because each top sheet 32 must pass along separator pad 58 for a greater distance. With the new input structures shown in FIGS. 6-11, the resistance of separator pad 58 to sheets fed off stack 42 decreases as stack 42 gets smaller and separator pad 58 moves out of or is shielded from media path 30, allowing each sheet to pass more easily. The characteristics of biasing springs 104, 124 and the geometry of pad swing arm 90, 110 may be varied as necessary to achieve the desired balance between the blocking effect of separator pad 58 when a stack 42 is loaded into tray 16 and the resistance of separator pad 58 to sheets fed off stack 42 as stack 42 gets smaller. Using comparatively stiff springs 104, 124, for example, may be desirable with lighter media to delay taking separator pad 58 out of media path 30 until stack 42 is very small. By contrast, more flexible springs 104, 124 may be desirable with heavier media to take separator pad 58 out of media path 30 while stack 42 is still quite large.

The exemplary embodiments shown in the figures and described above illustrate but do not limit the invention. Other forms, details, and embodiments may be made and implemented. Hence, the foregoing description should not be construed to limit the spirit and scope of the invention, which is defined in the following claims.

What is claimed is:

1. A sheet media input structure for a sheet media processing device having a pick/feed mechanism operative to move media sheets from the input structure along a media path, the input structure comprising:

a sheet media supporting surface;

a wall downstream from the supporting surface along a media path that extends from the supporting surface to and along the wall;

a separator pad adjacent to the wall;

a swing arm having a first part carrying the wall and a second part exposed to sheets supported on the sheet media supporting surface, the swing arm pivotable in response to pressure on the second part applied while picking a top sheet from the sheets on the sheet media supporting surface from a first position in which the wall does not shield the separator from the media path to a second position in which the wall shields the separator pad from the media path; and an idler roller mounted to the second part of the swing arm and wherein the second part of the swing arm is exposed to sheets supported on the sheet media supporting surface through the idler roller.

2. The structure of claim 1, further comprising a biasing mechanism operatively coupled to the swing arm to bias the swing arm toward the first position.

3. A sheet media input structure for a sheet media processing device having a pick/feed mechanism operative to move media sheets from the input structure along a media path, the input structure comprising:

a sheet media supporting surface;

a wall downstream from the supporting surface along a media path that extends from the supporting surface to and along the wall;

a separator pad adjacent to the wall;

a swing arm having a first part carrying the pad and a second part exposed to sheets supported on the sheet media supporting surface, the swing arm pivotable, in response to pressure on the second part applied while picking a top sheet from the sheets on the sheet media supporting surface, from a first position in which the wall does not shield the separator from the media path to a second position in which the wall shields the separator pad from the media path; and an idler roller mounted to the second part of the swing arm and wherein the second part of the swing arm is exposed to sheets supported on the sheet media supporting surface through the idler roller.

4. The structure of claim 3, further comprising a biasing mechanism operatively coupled to the swing arm to bias the swing arm toward the first position.

5. A sheet media pick mechanism, comprising:

a sheet media input structure comprising:

a tray having a base, a first sidewall on one side of the base and a second sidewall on an opposite side of the base, part of the base defining a surface for supporting media sheets in the tray;

a stationary wall disposed at a front of the tray and oriented at an obtuse angle relative to the supporting surface;

a movable separator pad disposed adjacent to the wall; and a first swing arm having a first end pivotally mounted to the base below the supporting surface, a second part carrying the separator pad, and a third part exposed to sheets supported in the tray, the third part of the swing arm located between the first part and the second part;

a second swing arm pivotable on an axis located above the tray;

a pick roller mounted to the second swing arm and positioned over the exposed third part of the first swing; and an idler roller mounted to the third part of the first swing arm below the pick roller and wherein the third part of the swing arm is exposed to sheets supported in the tray through the idler roller.

6. A printer, comprising:

a print engine;

a sheet media input structure;

a pick/feed mechanism operative to move media sheets from the input structure to the print engine along a media path;

a printer controller configured to control the operation of the print engine and the pick/feed mechanism;

the input structure including a sheet media supporting surface, a wall downstream from the supporting surface along the media path, a separator pad adjacent to the wall, and a swing arm having a first part carrying the wall and a second part exposed to sheets supported on the sheet media supporting surface, the swing arm pivotable in response to pressure on the second part applied while picking a top sheet from the sheets on the sheet media supporting surface from a first position in which the wall does not shield the separator from the media path to a second position in which the wall shields the separator pad from the media path.

7. The printer of claim 6, wherein the input structure further includes an idler roller mounted to the second part of the swing arm and wherein the second part of the swing arm is exposed to sheets supported on the sheet media supporting surface through the idler roller.

* * * * *

UNITED STATES PATENT AND TRADEMARK OFFICE

CERTIFICATE OF CORRECTION

PATENT NO. : 7,455,288 B2
APPLICATION NO. : 10/463486
DATED : November 25, 2008
INVENTOR(S) : Tom Ruhe et al.

It is certified that error appears in the above-identified patent and that said Letters Patent is hereby corrected as shown below:

In column 7, line 16, in Claim 5, delete "swing" and insert -- swing arm --, therefor.

Signed and Sealed this

Eighteenth Day of August, 2009

David J. Kappos

David J. Kappos
*Director of the United States Patent and Trademark Office*